United States Patent [19]

Ingermann et al.

[11] Patent Number: 4,920,604

[45] Date of Patent: May 1, 1990

[54] AUTOMATIC VACUUM BOWLING LANE STRIPPER

[75] Inventors: Donald E. Ingermann, Arvada; Ronald L. Smith, Boulder; Stephen F. Caffrey, Arvada; Lonney J. Steinhoff, Evergreen, all of Colo.

[73] Assignee: Century International Corporation, Golden, Colo.

[21] Appl. No.: 371,295

[22] Filed: Jun. 26, 1989

[51] Int. Cl.[5] ..... A47L 11/282

[52] U.S. Cl. ..... 15/302; 15/98; 15/319

[58] Field of Search ..... 15/4, 302, 312 R, 319, 15/98

[56] References Cited

U.S. PATENT DOCUMENTS

| | | | |
|---|---|---|---|
| 2,622,254 | 12/1952 | Mendelson | 15/320 X |
| 2,893,047 | 7/1959 | Swihart | 15/300 A X |
| 3,083,390 | 4/1963 | Wroten | 15/319 X |
| 3,216,036 | 11/1965 | Rockwood et al. | 15/319 X |
| 3,604,037 | 9/1971 | Varner | 15/4 |
| 3,729,769 | 5/1973 | Sharpless | 15/414 X |
| 3,868,738 | 3/1975 | Horst et al. | 15/4 |
| 4,246,674 | 1/1981 | Ingermann et al. | 15/4 |
| 4,369,544 | 1/1983 | Parisi | 15/320 |

*Primary Examiner*—Chris K. Moore

*Attorney, Agent, or Firm*—Fields, Lewis, Pittenger & Rost

[57] ABSTRACT

In accordance with the present invention, an apparatus is provided wherein cleaner is applied to all or a portion of the lane and the cleaner, oil and other residue is picked up by a vacuum head trailing the cleaner applicator in one trip from the foul line to the pit leaving the lane clean and dry. If desired, the cleaning operation can be limited to the last forty-five feet or so, since it is generally desirable to clean this portion of the lane more often than the front portion. On the return or reverse movement of the stripper, no cleaning operations are undertaken but cleaner may be permitted to flow from the cleaner storage tank to the applicator so that the applicator will have sufficient cleaner in it for the beginning of application on the next lane. Means is provided for bowing the vacuum head so that the center is lower than the side edges so that it conforms generally to the concave shape of a bowling alley. A waste tank is provided with appropriate baffles to separate the waste liquid and solids from an air stream created by a vacuum motor attached to the outlet of the waste tank.

15 Claims, 5 Drawing Sheets

AUTOMATIC VACUUM BOWLING LANE STRIPPER

This invention relates to a bowling lane stripper and more particularly to an automatic device wherein cleaner is applied to the dressing on the lane and the cleaner, dressing and dirt are immediately vacuumed from the lane and removed in a single trip of the stripper down the lane.

BACKGROUND ART

The closest and most pertinent prior art known to applicant is that which forms the subject matter of Varner U.S. Pat No. 3,604,037 and Horst et al. U.S. Pat No. 3,868,738 both of which are now owned by the assignee hereof. The first of these patented lane conditioning machines has proven to be very versatile and eminently satisfactory for performing a variety of necessary operations but is quite expensive due to its complexity. It includes buffers, applicators for applying both lane dressings and cleaners, dusting mechanisms using moving cloth webs, lane position sensors and sophisticated cam actuated controls for initiating and terminating the various operations at precise positions along the lane. More specifically, the primary functions to be performed by the machine disclosed in the Varner patent were those of dressing the first forty-five feet of the lane with a thin coating of oil and then stripping all oil, dust and dirt from the remainder of the lane all the way back to the pin deck on a daily basis. This stripping operation utilized a rotating drum-type applicator to which the cleaner was applied as it turned. Since the amount of oil on the remote end of the lane is basically only that which is carried there by the ball as it rolls from the dressed section toward the pins it is easily removed with a very small amount of cleaner. For this purpose, the cleaner applicator of the Varner patent proved to be quite satisfactory. However, it can not clean the much greater quantity of dirt and oil from the dressed portion of the lane. There appeared to be several reasons for this, not the least of which was the inability of the rotating applicator to handle the accumulation of dirt and oil so as to leave the lane stripped of all foreign matter. The roller itself could not hold enough cleaner to properly remove the oil from the dressed section of the lane and, as a result, any applicator subassembly for use on this part of the lane would, of necessity, have to be redesigned.

In addition to the rotating cylindrical applicator, the cleaner reservoir and system of nozzles for wetting the applicator proved to be a source of trouble when attempts were made to adapt them to the volume of cleaner needed to strip the dressed section of the lane.

Another analogous, but nonetheless different, problem was that of picking up the suspension consisting of the insoluble particulate matter suspended in the cleaner with the oil dissolved therein so as to leave the lane clean and ready to be dressed. In the Varner unit, small amounts of cleaner were sprayed onto a pad which rested atop the rotating applicator and transferred the cleaner thereto. Also engaging this applicator was a dust cloth which removed the dust from its surface. While provision was made for unrolling the dust cloth when the area thereof in contact with the applicator got dirty, no fresh dust removal surface was supplied on a continuous basis nor was one needed since the amount of dust picked up by the applicator on the undressed part of the lane was minimal. A continuously changing dust cloth was passed underneath a wiper pad at the opposite end of the unit but it was not intended, nor was it used, to clean cleaner and particulate matter from the wet applicator. The stationary dust cloth in contact with the applicator proved to be unsatisfactory in removing from the rotating applicator the vastly greater amount of cleaner it had to be supplied with in order to clean the dressed section of the lane.

The Horst et al. patent refers to the need for a lane-conditioning machine that is both less complicated and less expensive than the one forming the subject matter of the Varner patent. The latter unit differs materially from the former one in that it includes no provision for stripping oil from the lanes. Instead, it only applies an oil dressing thereto, buffs and dusts the lane. Furthermore, none of the subassemblies present in the Horst et al. machine is any more satisfactory than those of the Varner patent for either stripping the oil from the dressed areas of the lane or removing the residues left following such an operation.

The net result as far as the bowling alley proprietor is concerned is that he or she must still manually strip the oil from the dressed portions of the lane on a periodic basis, usually once a week. The Varner machine is effective on a daily basis to strip the oil from the undressed sections of the lane and to re-oil the dressed section but not to strip it. The Horst et la. machine, on the other hand, is even more limited since it can only dress the lane and it includes no provision for stripping it whatsoever.

An automatic lane stripper machine disclosed in Ingermann et al. U.S. Pat No. 4,246,674 was a much needed adjunct to assignee's existing pair of patented conditioning machines referred to previously. It includes the simple, yet unobvious, expedient of replacing the driven roller type applicator with a wettable pad that remains in contact with the lane surface during the excursion of the machine from the foul line to the pin deck. Cleaner is applied directly to this pad in amounts anywhere from about seven to over a hundred times that which the Varner unit is capable of handling using the wiping action by means of which cleaner is transferred from a wiper pad to the surface of the applicator roller. A moving web of absorbent material is used to not only dust the lane as in the previously-described machines but to continuously wipe the absorbent surface of the rotating pick-up roller and remove the solid and liquid residues therefrom before they can be returned to the surface of the lane. The dusting function of the moving web and the buffing function of the residue pick-up roller, while significant, are nonetheless subordinate to their main functions of removing all liquid and solid residues left over following the stripping operation from the surface of the lane since, in each instance, the lane will be re-oiled and buffed with other machinery or by hand before being used.

Other aspects of the Ingermann et al. stripper have to do with the way in which it is supported as it runs to and fro along the lane and its various operations controlled as a function of its location as determined by feelers and means responsive to the main carriage drive. More specifically, the applicator is charged with its supply of cleaner during portions of both its forward and return runs, the latter while it is raised up into its inoperative position thus giving the charge an opportunity to disburse evenly along the pad before becoming operative again. Some of these same feelers sense the position of the unit so as to reverse its direction of movement, deactuate the applicator while re-activating the cleaner supply mechanism in a manner to charge the latter with cleaner and terminate the stripping cycle as the unit returns to the foul line.

Finally, the rotating pick-up roller further removes any remaining debris or liquid cleaner from the bowling lane and the moving web follows along therebehind to provide a final wiping function. Thus, the Ingermann et al. stripper preforms cleaning functions during both the forward and reverse movement of the apparatus along the lane.

DISCLOSURE OF THE INVENTION

In accordance with the present invention, an apparatus is provided wherein cleaner is applied to all or a portion of the lane and the cleaner, oil and other residue is picked up by a vacuum head trailing the cleaner applicator in one trip from the foul line to the pit leaving the lane clean and dry. If desired, the cleaning operation can be limited to the last thirty-six feet or so, since it is generally desirable to clean this portion of the lane more often than the front portion. On the return or reverse movement of the stripper, no cleaning operations are undertaken but cleaner may be permitted to flow from the cleaner storage tank to the applicator so that the applicator will have sufficient cleaner in it for the beginning of application on the next lane. Means is provided for bowing the vacuum head so that the center is lower than the ends to conform generally to the concave shape of a bowling alley. A waste tank is provided with appropriate baffles to separate the waste liquid and solids from an air stream created by a vacuum motor attached to the outlet of the waste tank.

More particularly, the present invention includes a carriage for movement along a bowling alley from the foul lane to the pit and back again, the carriage having a forward portion and a rear portion. A reversible drive mechanism is connected to the carriage and has a drive shaft and surface-engaging drive wheels mounted on the shaft operative to advance the carriage along a predetermined course in a forward and reverse direction. Cleaner applicator means extends transversely of the carriage in the forward portion thereof and is mounted for movement with respect to the carriage between an operative lane-engaging position and a retracted position within the carriage and above the lane. A cleaner reservoir supplies cleaner to the applicator by means of a fluid valve which permits the flow of cleaner to the applicator when open and prohibits flow of cleaner to the applicator when closed. A vacuum means is provided for removing cleaner and dirt from the surface of the lane, the vacuum means having a vacuum head extending transversely of the carriage, but rearwardly of the applicator means, and is mounted for movement between an operative lane engaging position and a retracted position within the carriage and above the lane. Power supply means is provided to the carriage. Control means is connected to the power supply means and is responsive to control signals to selectively activate and deactivate each function of the stripper. An on-off switch is provided which can be closed for activating the drive mechanism so that the carriage travels in a forward direction from the foul lane to the pit. First means responsive to the control means is provided for opening the fluid valve during at least a portion of the forward travel. Second means is provided which is responsive to the control means for moving the applicator into the lane-engaging position. A third means is responsive to the control means for moving the vacuum head into the lane-engaging position. A fourth means is responsive to the control means for deactivating the first and second responsive means to shut-off the fluid valve and to move the applicator to the retracted position. A limit switch is responsive to the carriage reaching the pit to cause the control means to deactivate the drive mechanism to stop the carriage and to deactivate the third responsive means to raise the vacuum head to the retracted position.

The control means can also include a timed delay means and motor reversing means responsive to the time delay means to activate the drive mechanism in the reverse direction for rearward travel along the lane from the pit to the foul line. A stop switch is provided for deactivating the drive mechanism when the carriage returns to the foul line. The control means can activate the first, second and third responsive means simultaneously or it can activate the second and third responsive means only after the carriage has traveled along the bowling lane a predetermined distance from the foul line to the pit. This permits the alternative of cleaning the entire lane or only the back end of the lane.

The first responsive means can include a first cam operatively connected to the drive mechanism for rotation in response to the movement of the carriage along the bowling lane and a first cam switch which is opened and closed in accordance with the angular rotational position of the first cam. The second responsive means and the third responsive means include a second cam operatively connected to the drive mechanism for rotation in response to movement of the carriage along the bowling lane and a second cam switch means which is opened and closed in accordance with the angular rotational position of the second cam. The fourth responsive means includes a third cam operatively connected to the drive mechanism for rotation in response to movement of the carriage along the bowling lane and a third cam switch which opens and closes in accordance with the angular rotational position of the third cam. These cams can be angularly adjusted to vary the location along the bowling lane at which each cam switch opens and closes to vary the operation of the device as conditions require. From the foregoing, it is apparent that a relatively simple but efficient bowling lane stripper has been provided which can lay down cleaner to dissolve the oil and suspend the dirt so that the cleaner, oil and dirt can all be picked up by a trailing vacuum head so that the lane is completely cleaned during one pass down the lane from the foul line to the pit.

Additional advantages of this invention will become apparent from the description which follows, taken in conjunction with the accompanying drawings.

BEST MODE FOR CARRYING OUT THE INVENTION

Figure 1:
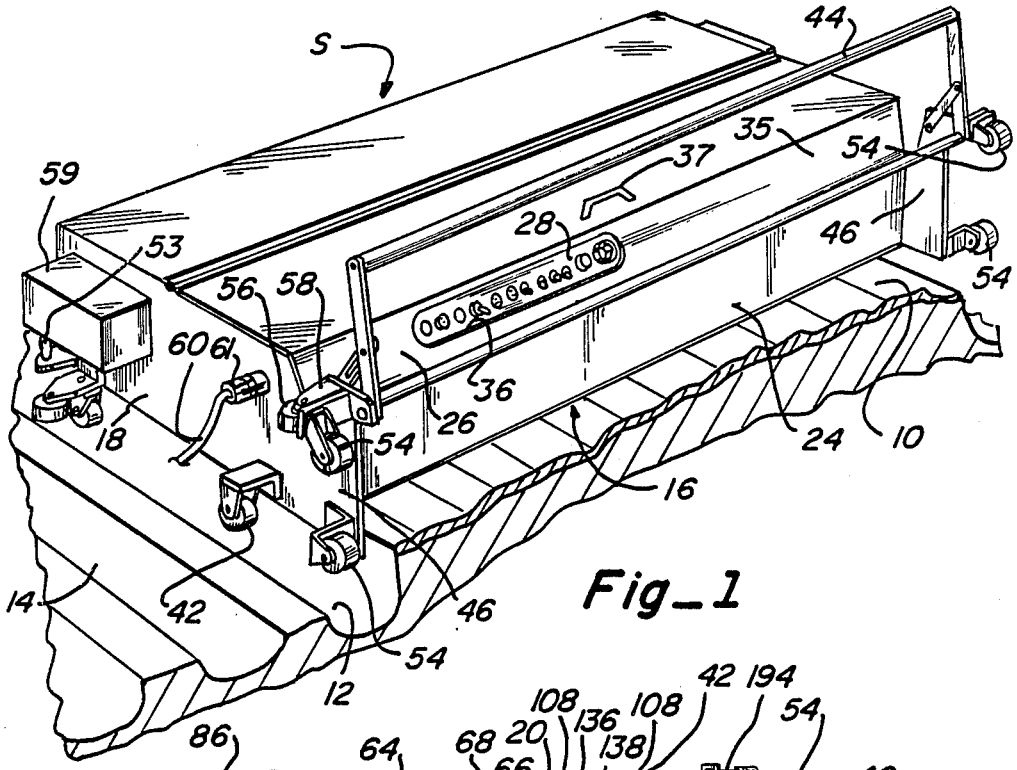
FIG. 1 is a perspective view of the lane stripper, constructed in accordance with this invention, in operative position on a bowling lane.

In accordance With the present invention, a lane stripper S is provided which can be mounted for travel along a bowling lane 10 which has conventional gutters 12 on either side and a ball return 14 on one side. Stripper S has a carriage 16 which houses all of the functional elements of the stripper. The carriage includes opposite side walls 18 and 20 interconnected by a front wall 22 and a back wall 24 having an inclined upper portion 26 on which a control panel 28 is mounted. Top cover 30 can be formed integrally with front wall 22 and has a trailing edge connected to a lid 32 by means of a piano hinge 34. Lid 32 has a flange 35 which extends over inclined portion 26 and is provided with an elongated opening 36 aligned with control panel 28. Conveniently, a handle 37 is provided for opening lid 32.

Figure 2:
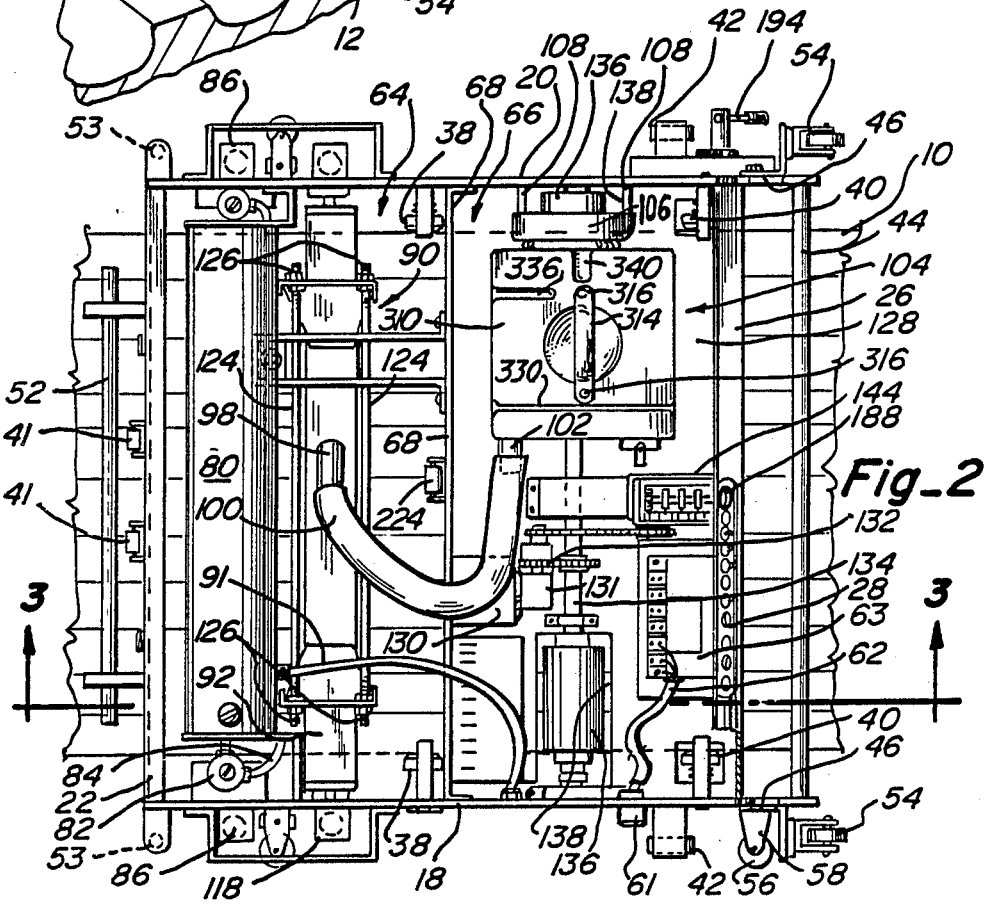
FIG. 2 is a top plan view of the lane stripper of FIG. 1, with the top cover removed.
Figures 3, 4, 5:
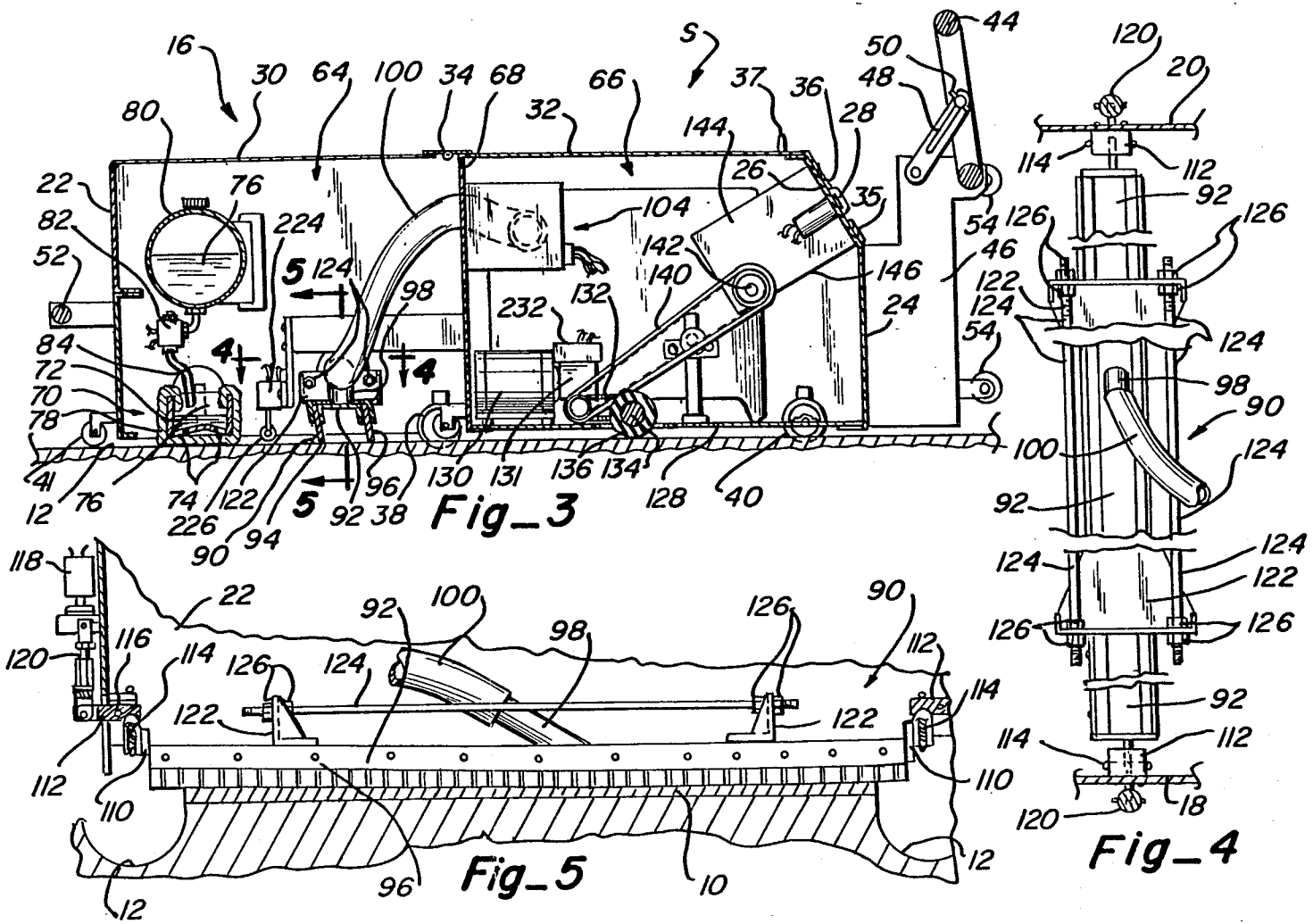
FIG. 3 is a vertical section, taken along line 3—3 of FIG. 2, showing details of the components contained within the forward and rear portions of the carriage.
FIG. 4 is a fragmentary, enlarged, top plan view of the vacuum head showing details of construction thereof.
FIG. 5 is a horizontal section, taken along line 5—5 of FIG. 3, showing further details of the vacuum head.

When mounted on bowling lane 10 in its lane traveling position, as shown in FIG. 1, stripper S aligned on the bowling lane by front guide wheels 38 on opposite sides of the bowling lane and rear guide wheels 40 similarly mounted, as best seen in FIG. 2. The front of carriage 16 is supported by a pair of spaced rollers 41 which are mounted from front wall 22. Another pair of wheels 42 extend out over gutters 12 and support the carriage when it moves across the foul line and up onto the approach. A handle 44 extends across the rear end of the carriage and can be used to lift that portion of the carriage and properly align it with the gutter prior to beginning a cleaning operation. This handle is pivotally attached to a pair of upright supports 46 and is adjusted by means of a linkage 48 and a thumb screw 50, as shown in FIG. 3. Front handle 52 is attached to front wall 22 and can be used along with side handles 53 attached to flanges at the front portion of each of side walls 18 and 20 so that the carriage 16 can be raised to a upright position whereby it is supported on casters 54. In this upright position the carriage 16 can be wheeled from a storage location to an alley or from one alley to the next. Limit wheel 56 is attached to support 46 by a bracket 58 and protects housing 60 from contacting any structure located outside the lane. Power is supplied through an extension cord 60 to a receptacle 61 and through an electrical conduit 62 to the control module 63 to which the control panel 28 is connected, as discussed more fully below.

As best seen in FIGS. 2 and 3, carriage 16 is divided into a front section 64 and a rear section 66 which are divided by a central wall 68. The forward end of front section 64 houses a cleaner applicator 70. This applicator is substantially identical to the applicator shown in the above-mentioned Ingermann et al. U.S. Pat No. 4,246,674. The applicator includes a rectangular receptacle 72 having a plurality of opening 74 spaced therealong through which cleaner 76 passes and is absorbed by pad 78 to be applied to the surface of alley 12 when the pad is in contact therewith. The pad can be attached to container 72 by any suitable fastening means. Velcro strips having been found to be satisfactory. The cleaner is supplied from a cleaner tank 80 through a control valve 82 and tubing 84. Conveniently, cleaner applicator 70 is mounted for reciprocal vertical movement wherein it can be moved between a lowered position, as shown in FIG. 3, wherein it engages the surface of the bowling lane 10, to apply cleaner thereto and emulsify the oil and to suspend any solid dirt particles on the lane, and a raised position spaced from the lane. This is accomplished by means of solenoid valves 86 connected to opposite ends of the applicator and mounted within housings 59. The operation of the solenoids in raising and lowering the applicator is the same as that to be described below with respect to vacuum head 90. A drain tube 91 is provided for emptying tank 80, as for shipment or long term storage. This tube runs from the tank to a quick disconnect device on side wall 18.

Located within forward section 64 but rearwardly of cleaner applicator 70 is vacuum head 90. Vacuum head 90 includes a rectangular housing 92 having a front squeegee 94 connected along the front edge of housing 92 and a rear squeegee 96 attached to the rear edge of housing 92. Discharge tube 98 is connected to an opening in housing 92 at one end and has an opposite end connected to a vacuum hose 100. The opposite end of the hose is connected to an inlet 102 of waste tank 104. The outlet of waste tank 104 is connected to a vacuum motor 106, mounted side wall 20 by means of supports 108.

A block 110 is attached to each end of housing 92. Each block is connected to a pivot arm 112 by means of a spring fastener 114. Arm 112 is pivoted intermediate its ends about pivot pin 116. A solenoid 118 is connected to the other end of arm 112 through an adjustable linkage 120. Thus, when solenoid 118 is energized linkage 120 will move upwardly so as to pivot lever 112 and push the vacuum head 90 downwardly so that the squeegees 94 and 96 engage bowling lane 10. The solenoid and linkage arrangement just described is identical for cleaner applicator 70 so that it is raised and lowered in the same manner.

The surface of a typical bowling lane 10 is slightly concave due to the wear created by the bowling balls rolling across it. In order to maximize the squeegee contact with the surface, it is desirable to bow vacuum head 90 so that the squeegees 94 and 96 have a generally convex configuration which matches the concave configuration of the bowling lane. Spaced inwardly from each end of housing 92 is a upstanding bracket 122 having a lower end about the same width as housing 92 and an upper end which is wider than housing 92. A pair of spaced tension rods 124 extend between the upper flanges of these brackets and are threaded at each end. The ends of the tension rods 124 are held in engagement with the brackets by nuts 126 received on the ends thereof. Thus, by adjusting the nuts, the tension in rods 124 can be increased to increase the curve of housing 92 and of squeegees 94 and 96. Conversely, by loosening nuts 126 the tension on rods 124 can be decreased and the amount of curve decreased in the housing in squeegees.

Rear section 66 is provided with a floor or bottom panel 128. Within this section a drive motor 130 is mounted which provides the power for moving the carriage along the bowling alley surface and for driving the control mechanisms to be described. The motor is connected through a gear box 131 to a suitable sprocket and chain drive 132 which rotates drive shaft 134 which is journaled at each end on side walls 18 and 20 respectfully. Conveniently, adjacent each end of drive shaft 134 are elongated drive rollers 136 which extend through openings 138 in floor panel 128 and engage the surface of bowling lane 10.

Figure 6:
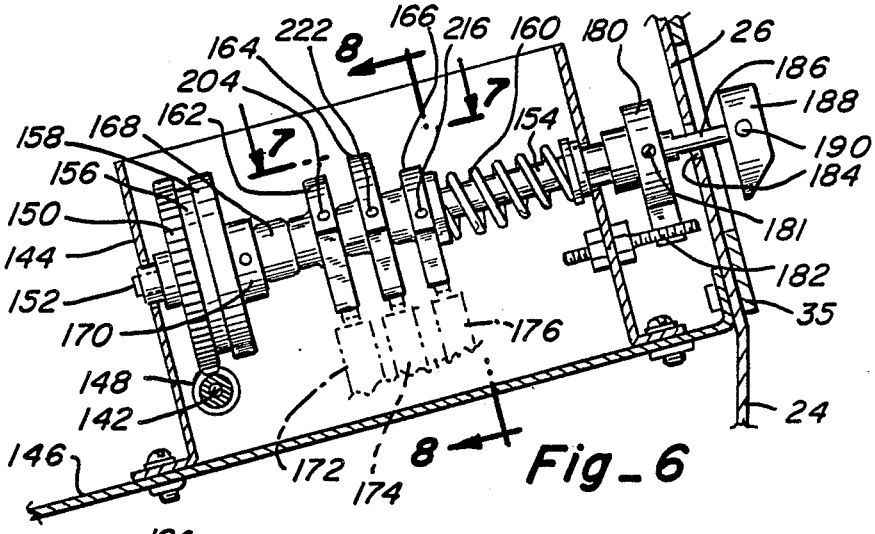
FIG. 6 is an enlarged vertical section, taken along line 6—6 of FIG. 2, showing the cams and switches associated with the control mechanism.
Figure 8:
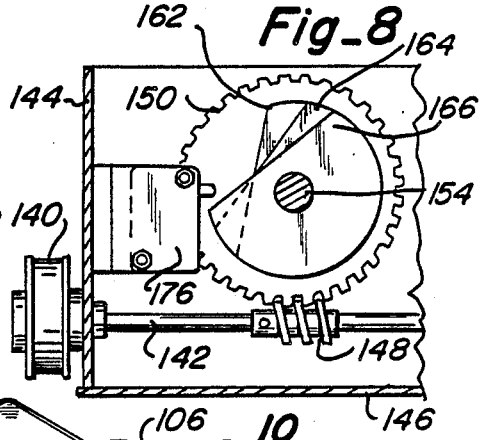
FIG. 8 is a section taken along line 8—8 of FIG. 6, showing still further details of the cams and switches.

Drive shaft 134 is also connected through a belt 140 to a timing shaft 142 and a control box 144. As best seen in FIG. 6, control box 144 can be mounted on a support plate 146 which extends from portion 126 to floor 128. From FIG. 8, it can be seen that timing shaft 142 includes a worm gear 148 which rotates a timing gear 150 in response to rotation of timing shaft 142. Timing gear 150 is fixedly mounted on a stub shaft 152 journaled in a forward wall of control box 144. A cam shaft 154 is axially aligned with stub shaft 152 and journaled in the rear wall of control box 144. This shaft 154 has a friction plate 156 attached at one end which bears against the face of cam gear 150. A pressure plate 158 bears against the opposite surface of friction plate 156 and is biased toward the friction plate by a coil spring 160 having one end bearing the rear wall of control box 144 and the other end bearing against cams 162, 164 and 166, respectfully, which in turn bear against a sleeve 168 which presses against collar 170 of pressure plate 158. Associated with cams 162, 164 and 166 are micro-switches 172, 174 and 176, respectfully, which are mounted on control box 144, as by a pair of brackets 178. These cams and switches activate and deactivate the various functions of the cleaner applicator 70 and vacuum head 90, as will be described more fully below.

Figure 14:
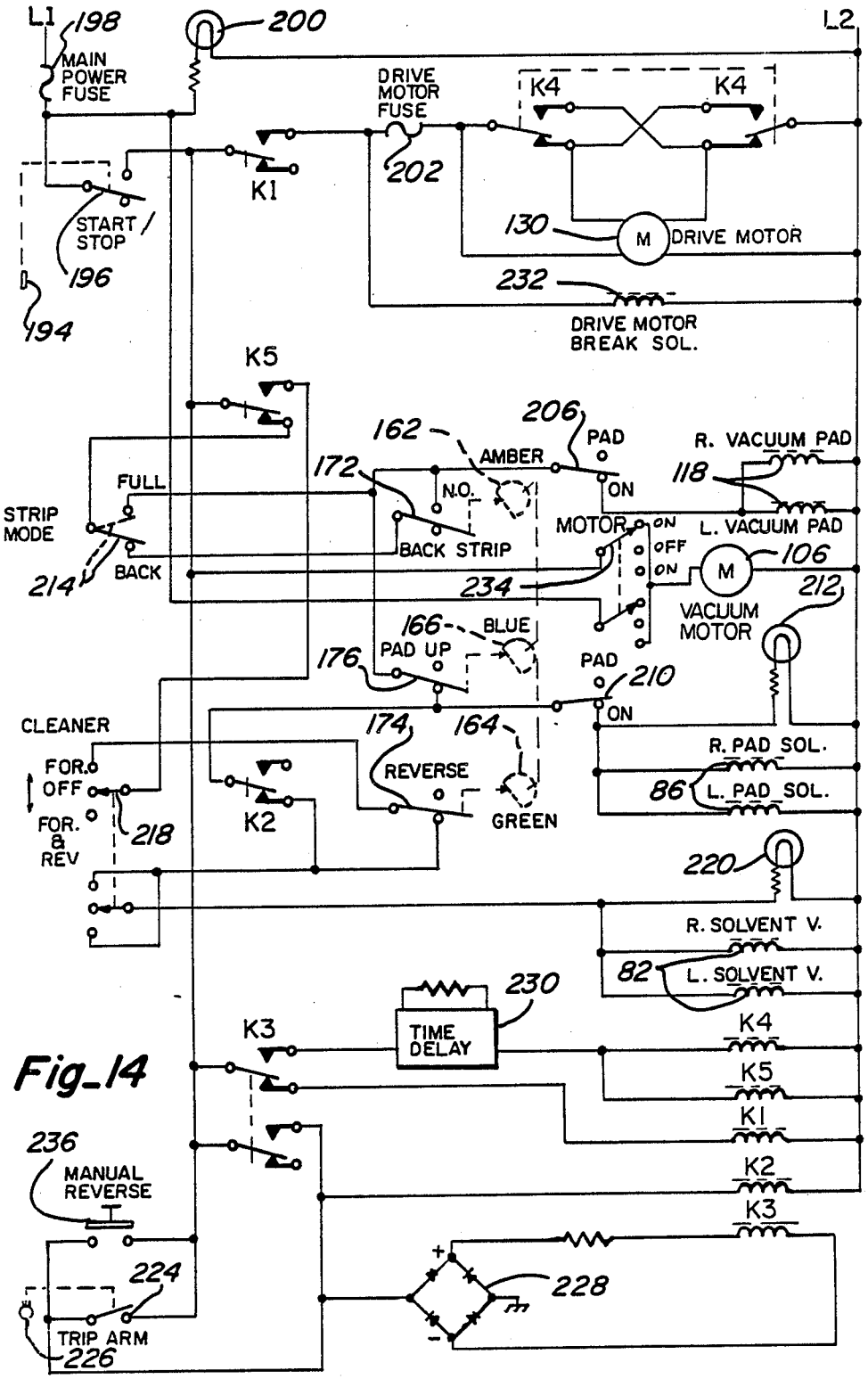
FIG. 14 is a circuit diagram for the controls for the lane stripper.

The opposite end of cam shaft 154 extends through the rear wall of housing 144 and has a limit arm 180 adjustably attached thereto, as by means of a set screw 181. The extent of rotation of cam shaft 154 will be limited by the engagement of limit arm with stop pin 182 which is also attached to the wall of control box 144. The upper portion 26 of rear wall 24 has an aperture 184 through which an end 186 of cam shaft 154 extends. Conveniently, this end may be of smaller circular diameter and has a knob 188 adjustably attached thereto, as by a set screw 190. This knob is used to assist in the positioning of the cams to initiate certain operations at appropriate locations along bowling lane 10. A scale 192 on control panel 28 provides a measuring means for determining how far down the alley the carriage has moved in order to set the cams appropriately to perform their functions. For example, if a function is to begin at 35′ from the foul line, knob 188 is turned to the indicia representing 35′ and the cams are adjusted as described below. When a cleaning operation is to begin, the start switch arm 194, shown in FIGS. 2 and 14, is rotated in a clockwise direction to close start/stop switch 196. Power is supplied through main power fuse 198 to main power light 200 which is connected in parallel with drive motor 130, as best seen in FIG. 14. The closing of the start/stop switch 196 energizes coil K1 which in turn closes corresponding gang switch K1 to provide power through drive motor fuse 202 to drive motor 130. This starts the carriage moving down bowling lane 10 by means of power supply to drive rollers 136, as previously described.

For convenience, the cams may be color coded so that the operator can easily distinguish one from the other. For example, cam 162 which controls the back stripping may be a distinctive color, such as amber. When the carriage has reached the position where the back stripping should begin and the machine has been shut-off, as just described, a set screw 204 on cam 162 is loosened and the amber cam moves so that the micro-switch 172 opposite this cam just clicks closed when it is engaged by the high dwell of the cam. Then the set screw 204 is tightened. Thus, each time the machine reaches this location on the bowling alley, cam 162 will close switch 172 closing the circuit through normally closed switch 206 to vacuum pad solenoids 118 which causes vacuum head 90 to be lowered.

Similarly, a circuit is closed through micro-switch 176 and closed pad switch 210 to energize solenoids 86 of cleaner applicator 70 to lower the applicator pad into contact with the bowling lane. This circuit also illuminates pad light 212 to indicated that pad switch 210 is in the on or closed position. When only back stripping is to occur, as just described, the strip mode switch 214 will be in the dotted line position so that solenoids 118 are operated only in response to the position of cam 162. On the other hand, when the full lane is to be stripped, the switch 214 will be placed in the solid line position shown in FIG. 14 so that the circuitry bypasses cam 162, as shown.

Figure 7:
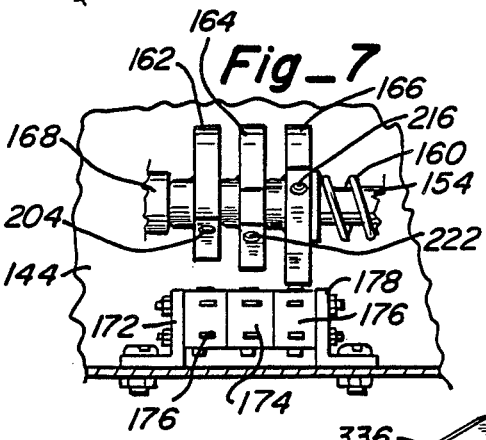
FIG. 7 is a section taken along line 7—7 of FIG. 6, showing further details of the cams and switches.

When the carriage reaches the pit area, it is necessary to raise the cleaner pad at least one foot before the end of travel of the carriage so that the cleaner deposited by the pad will be picked up by the vacuum head 90 before the carriage stops and the vacuum head is raised. To accomplish this, the carriage is run down the lane to the point at which it is desired that the vacuum pad be lifted. At this point the machine is shut-off and set screw 216, best seen in FIGS. 6 and 7, is loosened so that cam 166, which may be blue in color, can be set so that micro-switch 176 just closes when it is engaged by the high dwell portion of cam 166 to open the switch and break the circuit to solenoids 86 allowing the pad 78 to be biased upwardly away from the bowling lane 10, as previously described.

The cleaner is controlled by means of a double throw double pole three position switch 218 which has a central off position and an upper forward position wherein the cleaner is dispensed only during the movement of the carriage from the foul line to the pit and has an opposite reverse position wherein the cleaner is dispensed to the pad as the carriage moves from the foul line to the pit and during a portion of the travel from the pit back to the foul line. The latter arrangement is desirable when the lane stripper S is to be moved to another lane. Thus, during the rearward travel on one lane, cleaner is dispensed to the pad for application when the lane stripper is placed on the next lane. If this is not done, the pad may be too dry whereupon not enough cleaner will be applied to the next lane during the early part of its travel and if it is done for too great a period of time, the pad may be over saturated so that the cleaner drips from the pad onto the lane that has just been cleaned. As will be clear from looking at FIG. 14, when cleaner switch 218 is in either the forward or reverse position, a cleaner light 220 will be illuminated so that the operator can tell what the cleaner dispensing mode of the carriage is. In the forward or up position, valves 82 will be energized to allow the cleaner to flow.

If it is desired that cleaner be released from the tank to the pad during the reverse movement of the carriage, then before the cycle began the cleaner switch 218 would have been placed in the lower or reverse position. In this position, control of cleaner will be regulated by cam 164, which may be green in color and which can be set by means of set screw 222 to close micro-switch 174 during a selected portion of the return travel so that solenoid valves 82 are energized to dispense cleaner. During set up, when the carriage reaches the foul line, the start arm 194 will be turned in a counter clockwise position by the operator to open start/stop switch 196 so that the foregoing adjustment of cam 164 can be made.

When the carriage reaches the pit area, a microswitch 224 has a sensor in the form of a roller 226. This microswitch is mounted between cleaner applicators 70 and vacuum head 90, as shown with roller 226 engaging the surface of bowling lane 10. Thus, when the carriage reaches the pit area and roller 226 falls over the edge of the pit, micro-switch 224 will be closed. As best seen in FIG. 14, this will complete the circuit to bridge 228 to energize coil K3 and move double-pole double-throw switch K3 from the position shown in FIG. 4 to the opposite position whereupon solenoid K1 will be deenergized and switch K1 to be moved from a closed position to an open position to break the circuit to drive motor 130.

Also, the movement of switch K3 will activate time delay circuit 230. After the preset time delay period for time delay circuit 228 has expired, it will complete the circuit to solenoids K4 and K5. When motor 130 is deenergized, a circuit to drive motor break solenoid 232 will be energized to immediately stop the drive motor and stop the movement of the carriage so that it is not coast to a stop. Thus, its stopping position can be very precisely determined. Solenoid K4 will cause corresponding switches K4 to move to the opposite position shown in FIG. 14 thereby again activating motor 130, but in the reverse direction.

The energization of coil K5 will move switch K5 from the position shown in FIG. 14 to the opposite position which completely deactivates the strip mode switch and all of the vacuum solenoids 118 and cleaner pad solenoids 86 during the rearward travel of the carriage from the pit to the foul line.

Two other switches are present in the circuit which have not been specifically discussed. The first of these is a three position double-pole, double-throw vacuum motor switch 234 which has a central off position and upper and lower on positions. The switch is normally turned to the upper on position as soon as the carriage is properly positioned on the alley. Thus, when start/-stop switch 196 is closed, the vacuum motor will begin running. When switch 234 is in the lower on position, vacuum motor 106 will run whenever the power cord is plugged into an electrical outlet. In addition, there is a manual reverse switch 236 which is used during maintenance or adjustment periods whenever it is not desired to run the carriage all the way down to the pit before returning it to the foul line.

The construction and operation of waste tank 104 can be best understood by referring to FIGS. 9–12. The tank has a front wall 300, a rear wall 302 and opposed side walls 304 and 306. A bottom wall 308 and a top wall 310 complete the waste tank. Top wall 310 includes a central depression 312 for gripping handle 314 attached to the top thereof, as by fasteners 316. To remove the tank from the stripper, one need merely remove the end of hose 100 from inlet 102 and disengage locking clamp 318 from bracket 320 which is attached to side wall 300. Conveniently, locking clamp 118 is resiliently connected to waste tank support 322 by an elastic or stretchable cord 324. Extending upwardly from tank support 322 are four spaced positioning pins 326 which are received in corresponding sockets 328 in bottom wall 308 to properly position waste tank 104 in its operative position.

Figure 9:
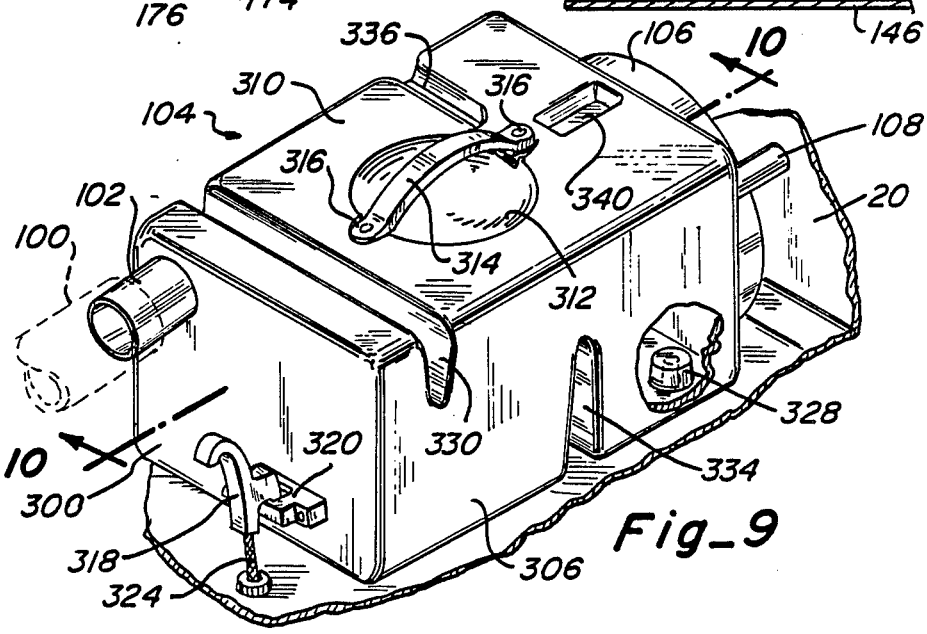
FIG. 9 is a perspective view of the waste tank used in the lane stripper.
Figure 10:
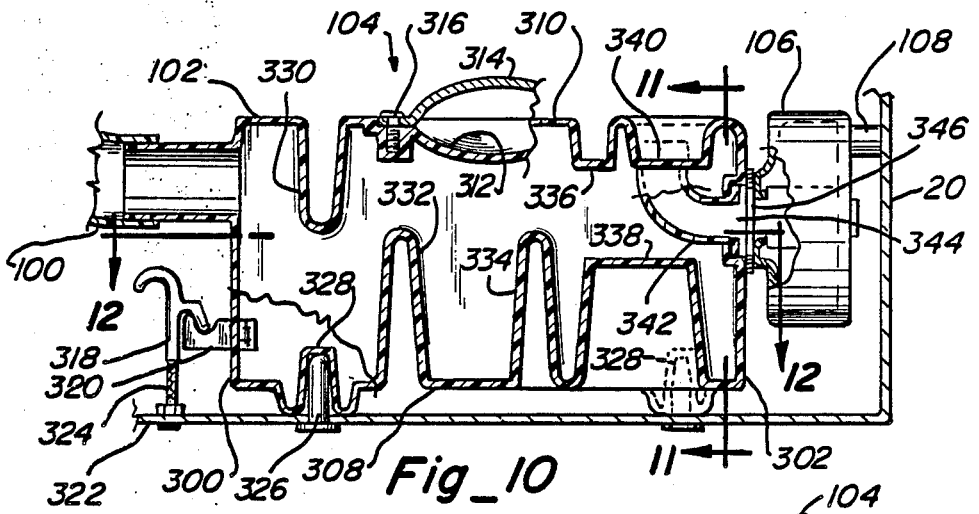
FIG. 10 is a horizontal section, taken along line 10—10 of FIG. 9, showing the internal baffle construction of the waste tank.
Figure 11:
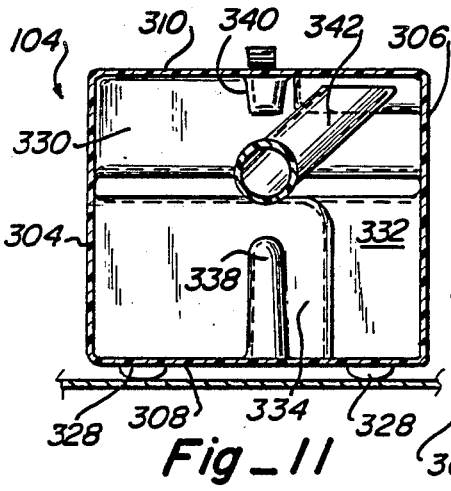
FIG. 11 is a vertical section, taken along line 11—11 of FIG. 10, showing additional details of the baffle construction.
Figure 12:
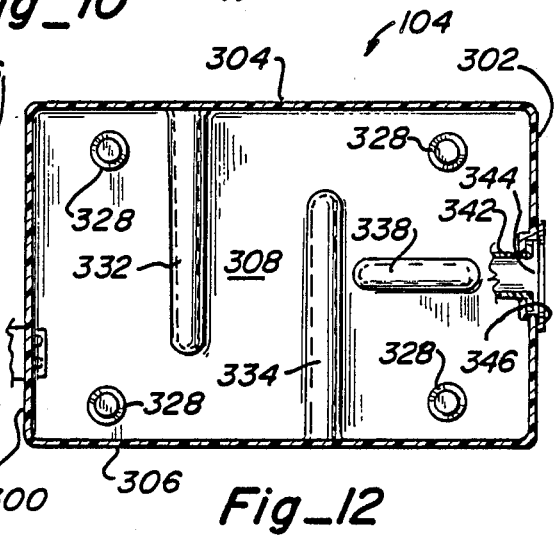
FIG. 12 is a horizontal section, taken along line 12—12 of FIG. 10 showing still further details of the baffle construction.
Figure 13:
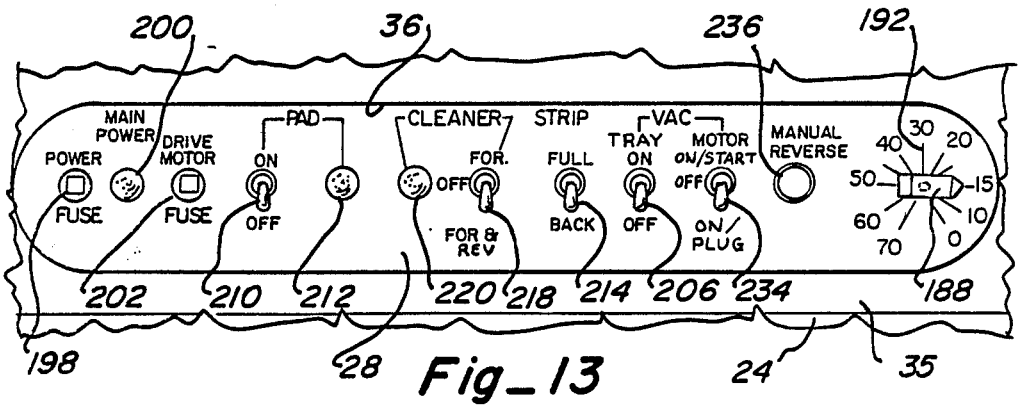
FIG. 13 is an enlarged elevation of the control panel shown in FIG. 1.

Adjacent inlet 102 is formed a transverse upper baffle 330 in top wall 310 which extends across the entire width of the tank from side wall 304 to side wall 306. As an airstream is drawn through inlet 102 by vacuum motor 106, it will strike baffle 130 causing liquid and solid particles carried by the air stream to drop toward the bottom and cause the air stream to move downwardly and around the baffle. Rearwardly of upper baffle 330 is a lower baffle 332 which is formed in bottom wall 308 and extends inwardly from side wall 304 about $\frac{3}{4}$ of the way across the tank and is spaced from side wall 306. Spaced rearwardly of baffle 332 is a second lower baffle 334 which also extends up from bottom wall 308 and is substantially identical to baffle 332 but extends inwardly from side wall 306 and is spaced from side wall 304. Thus, the air stream must pass in a generally sinusoidal path around these baffles. As the air stream strikes the baffles additional liquid and solid particles will drop out of the air stream. Rearwardly of second lower baffle 334 is a second upper baffle 336 which extends inwardly from side wall 304 for a short distance, as best seen in FIG. 9. Concluding the baffle arrangement is a longitudinal lower baffle 338 which extends upwardly from bottom wall 308 and is slightly shorter than lower baffles 332 and 334 and a longitudinal upper baffle 340 extending downwardly from top wall 310, which is slightly shorter than either of upper baffles 330 and 336.

An angular discharge tube 342 has one end adjacent a real quadrant of waste tank 104 and the other end is connected to outlet 344 so that the air stream that is now substantially free of any liquid or solid particles can be drawn through vacuum motor 106. Conveniently, gasket 346 is provided surrounding outlet 344 to provide an air tight seal between the outlet and vacuum motor 106. It can be seen that with the arrangement of the inlets and outlets and baffles, even when waste tank 104 is tipped up so that side 306 is on the bottom as would occur when the stripper is placed in the upright position to rest on casters 54 for moving it from one location to another, no waste liquid will spill out of either the inlet or the outlet. In fact, outlet tube 342 is designed to always be located outside of the liquid within the tank.

From the foregoing, the advantages of this invention are readily apparent. A bowling alley lane stripper has been provided which is fully automatic and provides for stripping all or a portion of a bowling lane. This is accomplished by bringing an applicator pad bearing cleaner into contact with the lane which dissolves the oil and suspends any solid particles thereon, the liquid then being immediately picked up by a vacuum head which removes the liquid and dirt and dries the lane. A novel cam arrangement is provided for sequencing the operations so that the cleaner is dispensed at the appropriate time and shut-off at the right time and that the applicator pad and vacuum head are lowered and raised in sequence or simultaneously, as required.

A novel waste tank is provided which has suitable baffles so that the air stream carrying the liquid and solid particles passes through a torturous path causing the liquid and solid particles to drop out of the air stream before it passes through the vacuum motor. Also, the arrangement of baffles and inlet and outlet hoses assures that no spilling of the waste material occurs when the tank is in either its normal position during use or tipped on its side when the stripper is placed in an upright position for movement from location to another.

This invention has been described in detail with reference to a particular embodiment thereof, but it will be understood that various other modifications can be effected within the spirit and scope of this invention.

We claim:

1. An automatic vacuum bowling lane stripper comprising:

a carriage for movement along a bowling alley from a foul line to the pit and back again, said carriage having a forward portion and a rearward portion;

a reversible drive mechanism connected to said carriage and having a drive shaft and surface-engaging drive wheels mounted on said drive shaft operative to advance said carriage along a predetermined course in a forward and reverse direction;

cleaner applicator means extending transversely of said carriage in said forward portion and mounted for movement with respect thereto between an operative lane-engaging position and a retracted position within said carriage and above the lane;

a cleaner reservoir;

means for supplying cleaner from said reservoir to said applicator, said cleaner supplying means having a fluid valve for permitting the flow of cleaner to said applicator when open and prohibiting flow of cleaner to said applicator when closed;

a vacuum means for removing cleaner and dirt from the surface of the lane, said vacuum means having a vacuum head extending transversely of said carriage rearwardly of said applicator means and mounted for movement with respect to said carriage between an operative lane-engaging position and a retracted position within said carriage and above the lane;

power supply means in said carriage;

control means connected to said power supply means responsive to control signals to selectively activate and deactivate each function of said stripper;

an on-off switch which can be closed for activating said drive mechanism so that said carriage travels in a forward direction from the foul lane to the pit;

first means responsive to said control means for opening said fluid valve during at least a portion of said forward travel;

second means responsive to said control means for moving said applicator into said lane-engaging position;

third means responsive to said control means for moving said vacuum head into said lane-engaging position;

fourth means responsive to said control means for deactivating said first and second responsive means to shut-off said fluid valve and to move said applicator to said retracted position; and a limit switch responsive to said carriage reaching the pit to cause said control means to deactivate said drive mechanism to stop said carriage and to deactivate said third responsive means to raise said vacuum head to said retracted position.

2. Apparatus, as claimed in claim 1, wherein said control means includes:

time delay means;

motor reversing means responsive to said time delay means to activate said drive mechanism in the reverse direction for reverse travel along the lane from the pit to the foul line; and a stop switch for deactivating said drive mechanism when said carriage returns to the foul line.

3. Apparatus, as claimed in claim 2, wherein said control means:

actuates said first responsive means during a portion of said rearward travel; and said stop switch deactivates said first responsive means to cut off flow of cleaner to said applicator when said carriage returns to the foul line.

4. Apparatus, as claimed in claim 1, wherein: said control means actuates said first, second and third responsive means simultaneously when said on-off switch is closed.

5. Apparatus, as claimed in claim 1, wherein: said control means actuates said second responsive means and said third responsive means only after said carriage has traveled along the bowling lane a predetermined distance from the foul line to the pit.

6. Apparatus, as claimed in claim 1, wherein: said first responsive means includes a first cam operatively connected to said drive mechanism for rotation in response to movement of said carriage along the bowling lane and a first cam switch which is opened and closed in accordance to the angular rotational position of said first cam;

said second responsive means and said third responsive means include a second cam operatively connected to said drive mechanism for rotation in response to movement of said carriage along the bowling lane and a second cam switch means which is opened and closed in accordance to the angular rotational position of said second cam; and said fourth responsive means includes a third cam operatively connected to said drive mechanism for rotation in response to movement of said carriage along the bowling lane and a third cam switch which is open and closed in accordance to the angular rotational position of said third cam.

7. Apparatus, as claimed in claim 6, further including:

means for angularly adjusting each of said cams to vary the location along the bowling lane at which each cam switch opens and closes.

8. Apparatus, as claimed in claim 1, wherein said vacuum head includes:

an elongated, generally rectangular housing extending transversely of said carriage having transverse front and rear edges, ends and a top, said housing having;

exhaust means extending through said top intermediate the ends thereof;

a squeegee depending from each of said front and rear edges; and means for bowing said housing so that said squeegees have a convex configuration in their longitudinal direction to closely fit the concave-configuration of a bowling lane.

9. Apparatus, as claimed in claim 8, wherein said bowing means includes:

laterally spaced flanges extending upwardly from said top of said housing; and rod means extending between said spaced flanges and connected thereto by adjustable attachment means to vary the tension applied to said rod means to adjust the bowing of said housing.

10. Apparatus, as claimed in claim 9, wherein said rod means includes:

spaced rods extending between said flanges, each of said rods being threaded; and said adjustable attachment means include threaded nuts received on said threaded rod ends for adjusting the tension of said rods.

11. Apparatus, as claimed in claim 8, wherein said vacuum means further including:

a waste tank with respect to said carriage having a top, a bottom, spaced forward and rear side walls positioned forwardly and rearwardly and spaced opposite front and rear end walls and having an inlet and an outlet in opposite end walls;

a vacuum hose connected between said exhaust means on said vacuum housing and said inlet of said waste tank; and a vacuum motor connected to said outlet of said waste tank to draw a vacuum from said housing through said vacuum hose and said waste tank.

12. Apparatus, as claimed in claim 11, wherein said waste tank includes:

internal baffle means to separate liquid and solid waste from a stream of air drawn through said vacuum means before it passes through said vacuum motor.

13. Apparatus, as claimed in claim 12, wherein said baffle means includes:

a first baffle spaced inside said inlet and extending downwardly from said top and across to each of said side walls for directing said air stream downwardly to enhance separation of the liquid and solids from the air stream;

a second transverse baffle spaced rearwardly of said first baffle extending upwardly and inwardly from one said side wall;

a third transverse baffle spaced rearwardly of said second baffle extending upwardly and inwardly from the other of said side walls causing the air stream to move in a generally sinusoidal path within said waste tank to further separate liquid and solid waste from the air stream;

a fourth longitudinal baffle located between said third baffle and said outlet extending upwardly from said bottom substantially at a right angles to said second and third baffles; and a fifth longitudinal baffle extending downwardly from said top and positioned above and spaced from said fourth baffle.

14. Apparatus, as claimed in claim 13, wherein:

said inlet is located adjacent the top of one of said end walls;

said outlet is spaced downwardly from the top of said other end wall; and a curved neck is provided in said waste tank having one end connected to said outlet and the other end extending toward a corner of said top and said forwardly spaced side wall but spaced from each.

15. Apparatus, as claimed in claim 11, wherein said waste tank has means for releasibly fastening it within said carriage, said means including:

spaced recesses extending upwardly from said bottom for receiving positioning posts within said carriage; and resilient locking means extending between said carriage and said waste tank to hold it in place on said posts.

* * * * *